US006067787A

United States Patent [19]

Wassenhoven

[11] Patent Number: 6,067,787

[45] Date of Patent: May 30, 2000

[54] OPEN-END ROTOR SPINNING DEVICE

[75] Inventor: Heinz-Georg Wassenhoven, Mönchengladbach, Germany

[73] Assignee: W. Schlafhorst AG & Co., Moenchengladbach, Germany

[21] Appl. No.: 09/246,067

[22] Filed: Feb. 8, 1999

[30] Foreign Application Priority Data

Feb. 27, 1998 [DE] Germany ..... 198 08 243

[51] Int. Cl.[7] ..... D01H 4/00

[52] U.S. Cl. ..... 57/407; 57/406

[58] Field of Search ..... 57/406, 407, 411, 57/413

[56] References Cited

U.S. PATENT DOCUMENTS

| | | | |
|---|---|---|---|
| 4,069,655 | 1/1978 | Stahlecker et al. | 57/58.91 |
| 4,112,659 | 9/1978 | Stahlecker et al. | 57/58.89 |
| 4,753,067 | 6/1988 | Landwehrkamp et al. | 57/407 |
| 5,337,552 | 8/1994 | Schuller et al. | 57/406 |
| 5,433,068 | 7/1995 | Stahlecker et al. | 57/407 |
| 5,611,195 | 3/1997 | Lovas et al. | 57/267 |

FOREIGN PATENT DOCUMENTS

| | | |
|---|---|---|
| 43 04 088 A1 | 8/1994 | Germany . |
| 43 23 213 A1 | 1/1995 | Germany . |
| 36 36 182 C2 | 10/1995 | Germany . |

*Primary Examiner*—William Stryjewski

*Attorney, Agent, or Firm*—Kennedy Covington Lobdell & Hickman LLP

[57] ABSTRACT

An open-end spinning device (1) with a spinning rotor (17) which is mounted with its rotor shaft (8) in the V-slots of a support-disk bearing (5) and whose spinning cup (17) rotates at a high speed in a rotor housing (6) which is open to the front and can be loaded by suction. The rotor housing (6) can be closed by a pivotably mounted cover element (10) which comprises a sliver opening device and is arranged so that it can be disengaged if required. The cover element (10) comprises a locking and unlocking device (20) with locking bolts (23) which can be controlled in a defined manner and which are movably mounted in bearing brackets (22) of the cover element (10). The locking bolts (23) engage during spinning operation in bearing locations (34) on the spinning box frame (2). The cover element (10) can be readily taken off the spinning box frame (2), if required, by appropriately actuating the locking and unlocking device (20).

5 Claims, 4 Drawing Sheets

OPEN-END ROTOR SPINNING DEVICE

BACKGROUND OF THE INVENTION

The present invention relates generally to open-end rotor spinning devices and more particularly to open-end spinning devices comprising a rotor housing having a forward opening, a spinning rotor defining a spinning cup supported for high speed rotation in the rotor housing, and a cover element for closing the forward opening of the housing.

Such open-end rotor spinning devices are known from various publications. By way of example, German Patent Publication DE 36 36 182 C2 describes rotor spinning devices which are fixed by their spinning box frames to the machine frame of an OE spinning machine. Each spinning box frame has a rotor housing which can be loaded by suction and in which rotates the rotor cup of a spinning rotor supported on support disks. The rotor housing, which is open to the front, is closed by a cover element during the spinning process.

In this known rotor spinning device the pivotably supported cover element also has a sliver opening device which comprises, as is customary, a sliver drawing-in cylinder, an opening roller or cylinder rotating in an opening-roller housing as well as a one-piece yarn guide conduit extending between the opening roller and the spinning rotor.

The spinning box can be opened in order to carry out maintenance work or other servicing. In this instance, the cover element is unlocked and folded down about a swivel pin located in the area of the rear of the spinning box. During the swiveling of the cover element both the drive whorl of the opening roller as well as the worm gear arranged on the end of the sliver drawing-in cylinder come out of engagement with the associated drive means, whereby the rotatable elements of the sliver opening device slow to a standstill. At the same time the braking of the spinning rotor is initiated via a lever linkage.

The position of the swivel pin of the cover element is particularly disadvantageous in this type of spinning box. The swivel pin, which is arranged relatively far behind the rotor cup, results in unfavorable geometric conditions and thereby in certain problems, especially during the pivoting in of the conduit plate extension which supports the sliver guide conduit for opening into the rotor cup.

The above-described disadvantage is avoided in open-end rotor spinning devices like those known, e.g., from German Patent Publications DE 43 23 213 A1 or DE 43 04 088 A1.

German Patent Publication DE 43 23 213 A1 describes by way of example a rotor spinning device whose cover element is mounted so that it can swivel about a swivel pin aligned orthogonally to the rotor axis at a location vertically below the rotor opening. The swivel pin about which the cover element can be pivoted is preferably formed by short bolts which are arranged in arms or brackets forwardly projecting from the wall of the spinning box frame and over which extend fastening lugs with slot-like recesses facing rearwardly from the cover element. The bolts are fixed in these recesses by securing means which can be unscrewed.

Thus, the pivotable cover element can be removed as an entire unit after loosening of the securing means. The arrangement of the swivel pin approximately vertically below the rotor opening results in a very small vertical offset to be taken into account during the pivoting in of the conduit plate extension and enables the mouth area of the sliver guide conduit to be placed very close to the sliver sliding wall of the rotor, which has a very positive effect on the spinning result. However, this known device has the disadvantage that the securing means arranged in the area of the swivel pin of the cover element can hardly be accessed or accessed only with very great difficulty in the case of spinning devices built into the textile machine.

The rotor spinning device according to German Patent Publication DE 43 04 088 A1 describes a rotor spinning device with a removable cover element which is detachably held via a fork-like holding fixture on a correspondingly formed support fixed to the wall of the spinning box frame. The cover element rests in the area of the drive shaft for the sliver drawing-in cylinder which extends the length of the machine and, thus, the cover element can be taken off transversely to its swivel pin without any securing elements or the like having to be loosened beforehand. However, the danger in such an embodiment that the folded-up cover element may come loose inadvertently from its support can not be entirely excluded.

SUMMARY OF THE INVENTION

In view of the known open-end rotor spinning devices of the above-described type, the present invention has the basic object of improving such rotor spinning devices.

The invention solves this problem in an open-end rotor spinning device basically comprising a spinning box frame, a rotor housing mounted on the spinning box frame and having a forward opening, a spinning rotor defining a spinning cup supported for high speed rotation in the rotor housing, and a cover element for closing the forward opening of the rotor housing. In accordance with the present invention, a locking and unlocking device is provided for mounting the cover element on the spinning box frame for selective pivotable opening and closing movement relative to the forward opening of the rotor housing. Basically, the locking and unlocking device comprises bearing locations in the spinning box frame, bearing brackets in the cover element, locking bolts movably arranged in the cover element bearing brackets, and a biasing device for urging the locking bolts into the bearing locations in the spinning box frame during spinning operation.

The fastening of the pivotably mounted cover element to the spinning box frame by means of movably mounted locking bolts which can be controlled in a defined manner has the advantage that, on the one hand, a secure fixing of the cover element to the spinning box frame is assured both when closed during the spinning process and also in an opened state and, on the other hand, the accessibility of the spinning box as well as of the cover element is significantly improved by simply taking off the cover element if needed, e.g., if adjustment or cleaning work is to be performed on the units of the sliver opening device integrated into the cover element. After the work is over the cover element can be reinstalled just as smoothly. No tool is necessary for mounting and dismounting the cover element nor are any time-consuming adjusting operations involved.

In an advantageous embodiment, the locking bolts comprise rotationally symmetric bearing portions or extensions positioned in the mounted state of the cover element in corresponding bearing boxes in the connection cheeks of the spinning box frame. The bearing portions of the locking bolts, which attachments are rotatably supported in the bearing boxes, form a pivot axis about which the cover element is mounted such that it can pivot when the spinning box is opened.

The locking bolts are preferably permanently loaded via a spring biasing element. That is, the locking bolts are constantly loaded in a direction urging the locking bolts outwardly into a locking position, so that it is assured in a simple manner that the cover element is constantly reliably fastened on the spinning box frame during the normal spinning operation and other work procedures.

Preferably, the two locking bolts are coupled to one another via a linkage arrangement, preferably consisting of articulated lever linkages including a connection means as well as an actuating lever. The locking bolts can thereby be uniformly controlled in a simple manner via a common actuation lever, to be simultaneously withdrawn if necessary out of their bearing boxes in the connecting cheeks of the spinning box frame.

In a preferred embodiment, the actuating lever is arranged in such a manner that it is only accessible when the cover element is open. That is, the cover element can only be taken off in an operating state in which it is reliably assured that the operating components (e.g., the spinning rotor and the opening roller) which rotate at a high speed during the spinning operation have already been brought to a standstill.

Further details, features and advantages of the invention are explained in and will be understood from the following description of an exemplary embodiment with reference to the accompanying drawings.

DESCRIPTION OF THE PREFERRED EMBODIMENT

Figure 1:
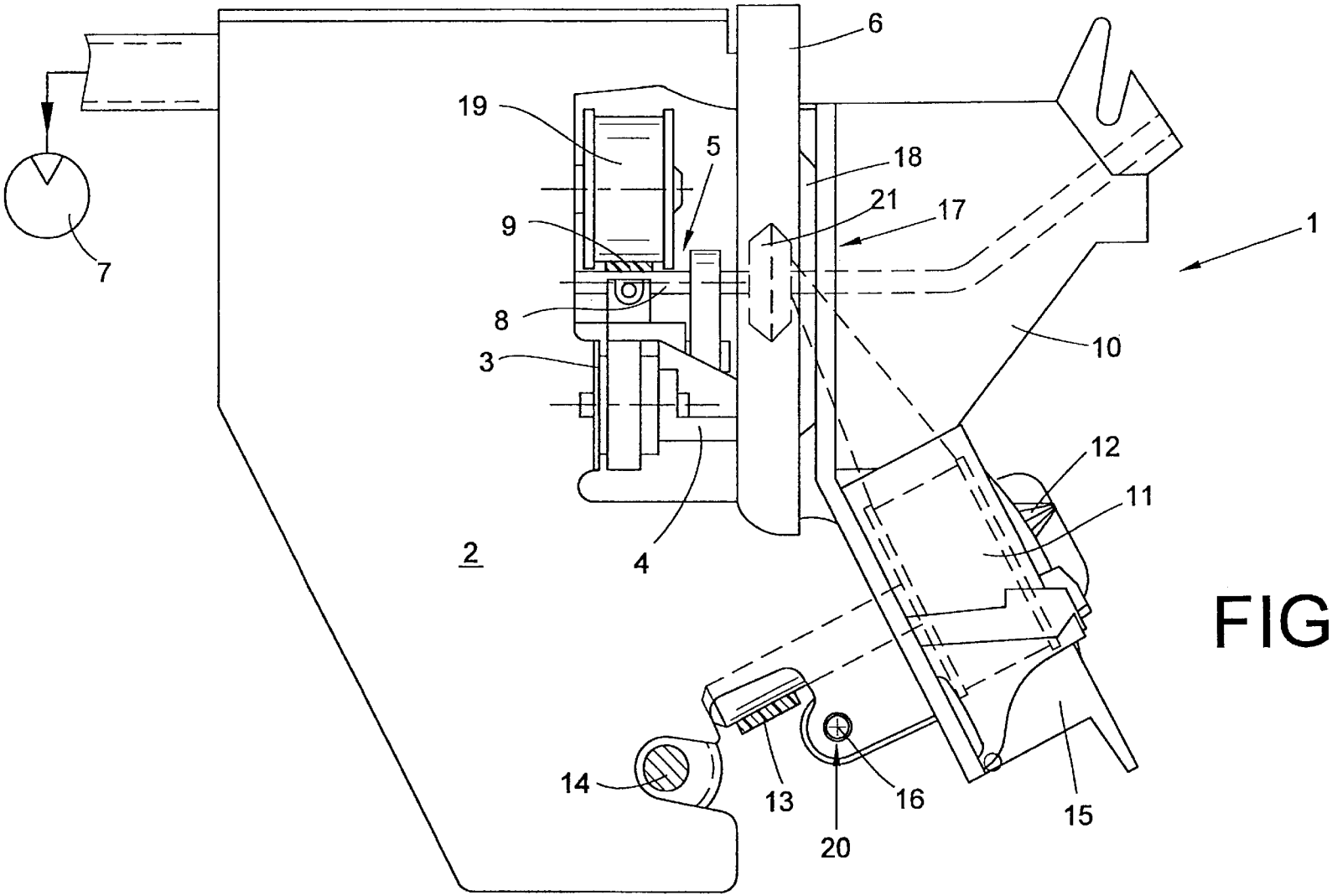
FIG. 1 is a side elevational view of an open-end spinning device in accordance with the present invention, shown in operating position with a pivotably mounted, readily removable cover element in closed position.
Figure 2:
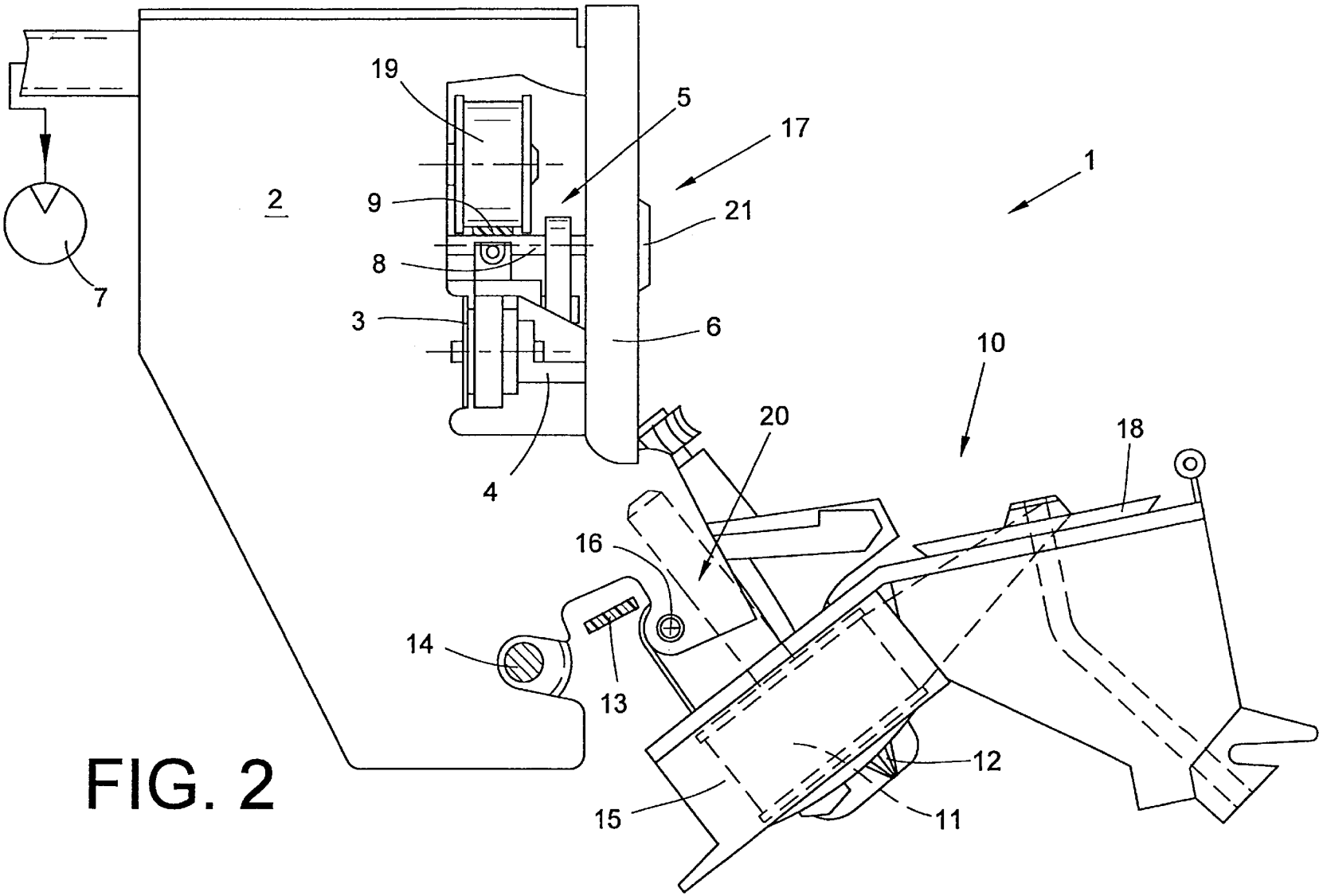
FIG. 2 is another side elevational view of the open-end spinning device of FIG. 1, showing the cover element in open position.

Referring now to the accompanying drawings and initially to FIGS. 1 and 2, an open-end spinning device 1 according to the present invention is shown in FIG. 1 in an operating state and in FIG. 2 in an opened state. As is known, the open-end spinning device 1 is a component of an open-end spinning machine (not shown in more detail) which comprises a plurality of these open-end spinning devices 1 aligned adjacent to each other in series. Each open-end spinning device 1 is fastened by a spinning box frame 2 on the machine frame (not shown) of the open-end spinning machine.

A bearing block 4, which carries support-disk bearing 5, is fastened to the spinning box frame 2 via fastening brackets 3. Spinning rotor 17 is supported with its rotor shaft 8 in the bearing nips of support-disk bearing 5 and is driven tangentially by belt 9 extending the length of the machine and is placed on rotor shaft 8 by pressure roller 19, such that the spinning cup 21 of the rotor rotates at a high speed in rotor housing 6. The belt 9 extends the length of the machine and is held in peripheral contact with rotor shaft 8 by pressure roller 19.

Rotor housing 6 is connected to vacuum source 7 and defines a forwardly facing opening which is normally closed by cover element 10 during the spinning operation. Specifically, cover element 10 has a so-called conduit plate and a lip seal 18 in the conduit plate by which the cover element 10 rests in an airtight manner on rotor housing 6. As is known, cover element 10 is mounted so that it can pivot in a limited manner about swivel pin 16 and cover element 10 carries a sliver opening device comprising opening roller 11 rotating in opening-roller housing 15 and sliver drawing-in cylinder 12. Opening roller 11 is driven by tangential belt 13 which extends the length of the machine and sliver drawing-in cylinder 12 is preferably driven by a worm gear or drive shaft 14 which similarly extends the length of the machine. Moreover, opening roller 11 is connected, as is customary, to spinning rotor 17 via a yarn guide conduit indicated in broken lines in FIGS. 1 and 2.

Cover element 10 is removably fastened to spinning box frame 2 and can be readily mounted or dismounted as required via locking and unlocking device 20 in accordance with the present invention. Locking and unlocking device 20, which is shown in partial section in FIGS. 3 and 4 comprises two rotationally symmetric locking bolts 23 movably mounted for axial sliding movement in bearing sleeves 28 supported by bearing brackets 22.

Figure 3:
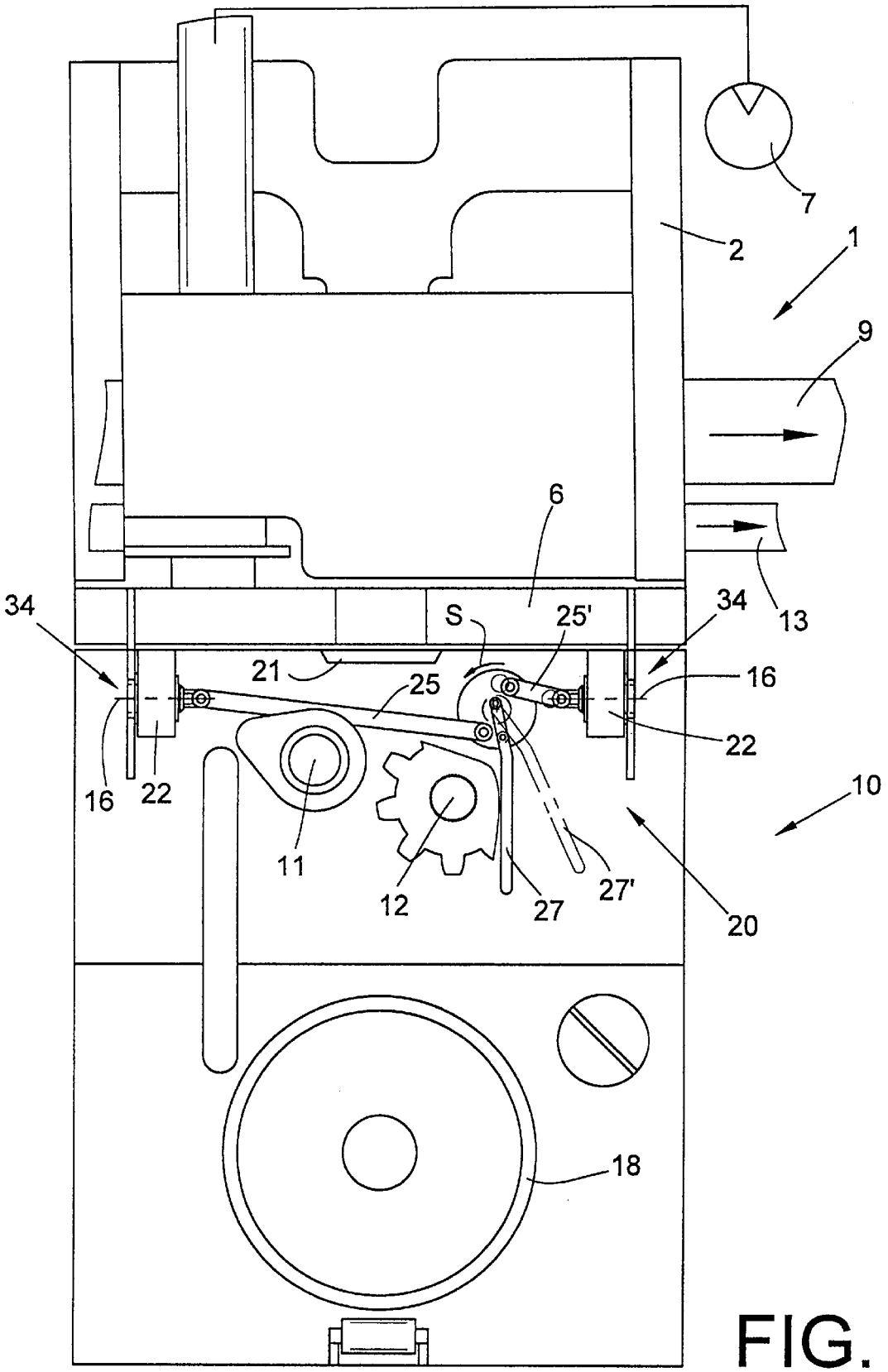
FIG. 3 is a top plan view of the open-end spinning device according to FIG. 2 showing the locking and unlocking device for the cover element in accordance with the present invention.
Figure 4:
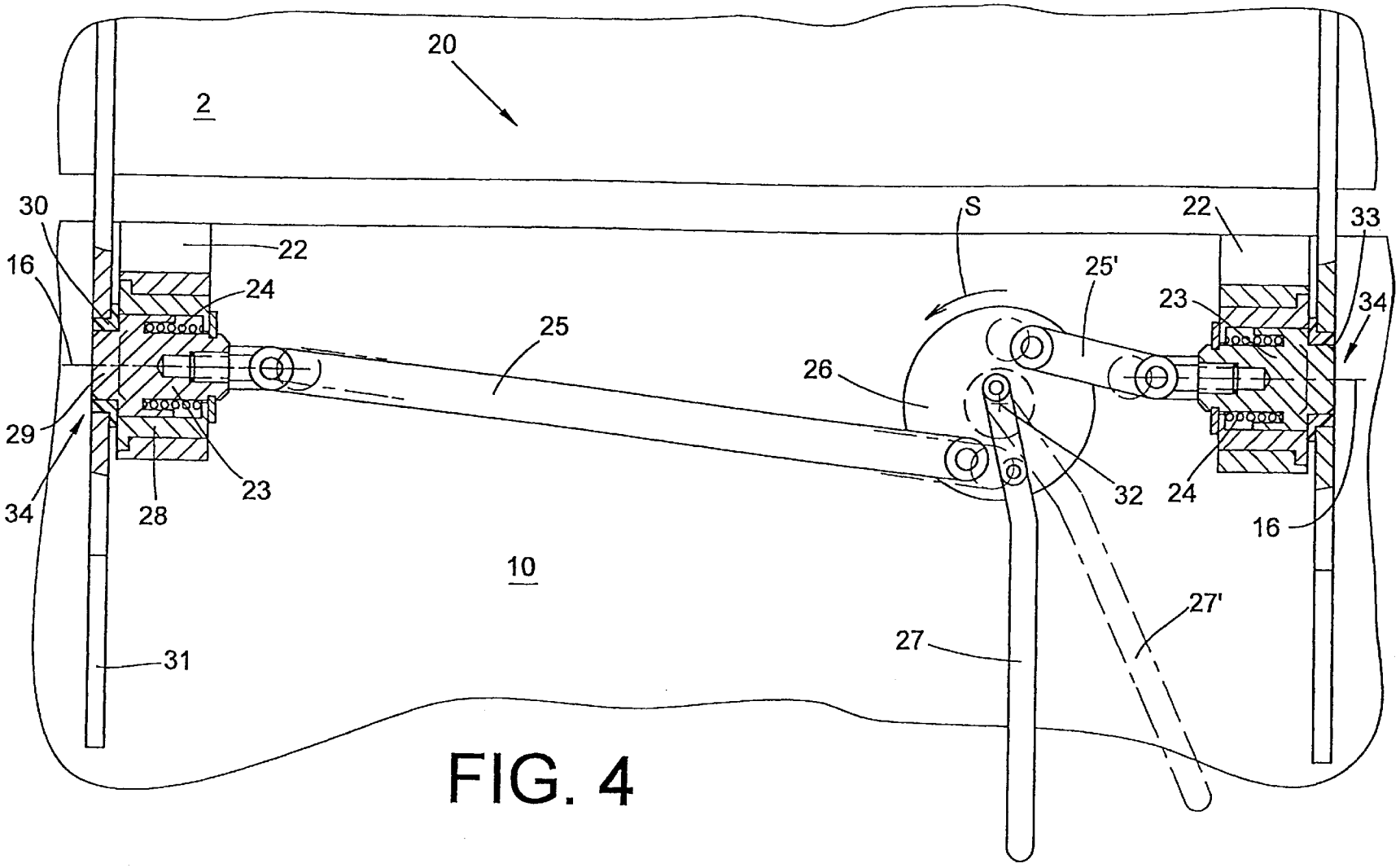
FIG. 4 is an enlarged elevational view, partially in section, of the locking and unlocking device in accordance with the present invention.

As is apparent from FIG. 4 in particular, locking bolts 23 are loaded via pressure spring 24 to urge the bolts 23 in an outward locking direction. The two locking bolts 23 are connected via lever linkages 25, 25' eccentrically to a rotatably mounted connection means such as the hub 26 which in turn has an actuating lever 27 connected radially thereto, whereby opposing rotational movements of the connection means 26 by actuating lever 27 produce articulated movements of the lever linkages 25, 25' inwardly and outwardly toward and away from the connection means 26 and in turn moving the locking bolts 23 inwardly against and outwardly with the biasing force of the springs 24. Locking bolts 23 have outwardly facing bearing portions or extensions 29 which, in the mounted state of the cover element 10 as shown in FIGS. 3 and 4, engage in bearing boxes 30 fitted in connection cheeks 31 of spinning box frame 2.

As is indicated in FIGS. 3 and 4, actuating lever 27 can be shifted manually into position 27'. During this shifting movement, connection means 26 is pivoted about its axis of rotation 32 in the direction of arrow S, thereby withdrawing locking bolts 23 via lever linkages 25, 25' against the biasing spring force of pressure springs 24 back into an unlocking position (not shown). During the withdrawal motion, bearing portions 29 of locking bolts 23 slide out of bearing boxes 30 in connection cheeks 31 of spinning box frame 2. Cover element 10 is thereby decoupled from connection cheeks 31 of spinning box 2 and can be removed without problems.

The installation mounting of cover element 10 takes place in the reverse sequence in a similar manner. That is, in order to mount cover element 10, locking bolts 23 are first withdrawn via actuating lever 27 and cover element 10 is introduced between connection cheeks 31 of spinning box frame 2 to position bearing portions 29 of locking bolts 23 centrally in front of bearing boxes 30 in connection cheeks 31. Upon the release of actuating lever 27 to move opposite the direction S into the position shown in full lines in FIG. 4, bearing portions 29 then extend outwardly under the biasing force of spring elements 24 into bearing boxes 30, so that cover element 10 is again connected to spinning box frame 12 for limited pivotal movement. Bearing portions 29 have a chamfer 33 on their outward ends to assist in insertion into the bearing boxes 30.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. An open-end spinning device comprising a spinning box frame, a rotor housing mounted on the spinning box frame and having a forward opening, a spinning rotor defining a spinning cup supported for high speed rotation in the rotor housing, a cover element for closing the forward opening of the rotor housing, and a locking and unlocking device for mounting the cover element on the spinning box frame for selective pivotable opening and closing movement relative to the forward opening of the rotor housing, the locking and unlocking device comprising bearing locations in the spinning box frame, bearing brackets in the cover element, locking bolts movably arranged in the cover element bearing brackets, and a biasing device for urging the locking bolts into the bearing locations in the spinning box frame during spinning operation.

2. The open-end spinning device according to claim 1, wherein the spinning box frame comprises connection cheeks having bearing boxes and the locking bolts comprise bearing portions on respective ends thereof for disposition in the bearing boxes in the connection cheeks of the spinning box frame.

3. The open-end spinning device according to claim 1, wherein the biasing device comprises spring elements arranged in the bearing brackets for urging the locking bolts to extend from the bearing brackets in an outward locking direction.

4. The open-end spinning device according to claim 1, wherein the locking and unlocking device further comprises a linkage arrangement for coupling the locking bolts, the linkage arrangement including an actuating lever for controlling movement of the locking bolts jointly in an inward unlocking direction.

5. The open-end spinning device according to claim 4, wherein the actuating lever is arranged for operation only when the cover element is open.

* * * * *